US009541085B2

(12) United States Patent
Uozumi

(10) Patent No.: US 9,541,085 B2
(45) Date of Patent: Jan. 10, 2017

(54) INTERNAL GEAR PUMP

(71) Applicant: SUMITOMO ELECTRIC SINTERED ALLOY, LTD., Takahashi-shi, Okayama (JP)

(72) Inventor: Masato Uozumi, Itami (JP)

(73) Assignee: SUMITOMO ELECTRIC SINTERED ALLOY, LTD., Okayama (JP)

( * ) Notice: Subject to any disclaimer, the term of this patent is extended or adjusted under 35 U.S.C. 154(b) by 205 days.

(21) Appl. No.: 14/353,747

(22) PCT Filed: Oct. 16, 2012

(86) PCT No.: PCT/JP2012/076659
§ 371 (c)(1),
(2) Date: Apr. 23, 2014

(87) PCT Pub. No.: WO2013/061820
PCT Pub. Date: May 2, 2013

(65) Prior Publication Data

US 2014/0271298 A1 Sep. 18, 2014

(30) Foreign Application Priority Data

Oct. 24, 2011 (JP) ..... 2011-232640

(51) Int. Cl.
*F03C 2/08* (2006.01)
*F04C 2/28* (2006.01)
(Continued)

(52) U.S. Cl.
CPC ..... *F04C 18/10* (2013.01); *F04C 2/084* (2013.01); *F04C 2/102* (2013.01)

(58) Field of Classification Search
CPC ..... F04C 18/00; F04C 2/084; F04C 2/102
(Continued)

(56) References Cited

U.S. PATENT DOCUMENTS 8,632,323 B2 * 1/2014 Uozumi ..... F04C 2/102 418/150
2010/0209276 A1 * 8/2010 Uozumi ..... F04C 2/102 418/54

FOREIGN PATENT DOCUMENTS

CN 1708647 A 12/2005
CN 101627209 A 1/2010
(Continued)

OTHER PUBLICATIONS

Maching English translation of WO2007034888 by Espacenet , Dec. 2015.*
(Continued)

*Primary Examiner* — Kenneth Bomberg
*Assistant Examiner* — Deming Wan
(74) *Attorney, Agent, or Firm* — Ditthavong & Steiner, P.C.

(57) ABSTRACT

An internal gear pump includes a pump rotor (4) in which a meshing point between an inner rotor (2) having n teeth and an outer rotor (3) having (n+1) teeth is located rearward, in a rotational direction of the rotor, relative to an eccentric axis (CL) along which a center ($O_I$) of the inner rotor and a center ($O_O$) of the outer rotor are disposed. A tooth-surface curve of the outer rotor (3) near a meshing section thereof is formed by duplicating thereto a tooth-surface shape of the inner rotor (2) near a meshing section thereof.

2 Claims, 9 Drawing Sheets

(51) Int. Cl.

| | |
|---|---|
| ***F01C 1/10*** | (2006.01) |
| ***F04C 18/10*** | (2006.01) |
| ***F04C 2/08*** | (2006.01) |
| ***F04C 2/10*** | (2006.01) |

(58) Field of Classification Search
USPC ..... 418/150, 166, 171
See application file for complete search history.

(56) References Cited

FOREIGN PATENT DOCUMENTS

| | | | | | |
|---|---|---|---|---|---|
| CN | 101832264 | A | | 9/2010 | |
| JP | 52-48805 | A | | 4/1977 | |
| JP | S63126568 | U | | 8/1988 | |
| JP | 6-39109 | Y2 | | 10/1994 | |
| JP | 10-61562 | A | | 3/1998 | |
| JP | 2009085213 | A | | 4/2009 | |
| JP | 4600844 | B2 | | 10/2010 | |
| WO | 2004044430 | A1 | | 5/2004 | |
| WO | WO 2007034888 | A1 | * | 3/2007 | ..... F04C 2/084 |
| WO | 2008111270 | A1 | | 9/2008 | |
| WO | WO 2010016473 | | * | 4/2010 | ..... F04C 2/084 |
| WO | 2011/058908 | A1 | | 5/2011 | |

OTHER PUBLICATIONS

Chinese Office Action for related Chinese Patent Application No. 201280050004.X dated Aug. 25, 2015, 12 Pages.
Korean Office Action for related Korean Patent Application No. 10-2014-7004013 dated Mar. 18, 2015, 6 pages.
International Search Report for corresponding International Application No. PCT/JP2012/076659, dated Jan. 22, 2013, 1 page.

* cited by examiner

INTERNAL GEAR PUMP

The present invention relates to an internal gear pump including a pump rotor formed by combining an inner rotor having n teeth and an outer rotor having (n+1) teeth. In particular, the present invention relates to an internal gear pump in which a meshing point of the inner rotor and the outer rotor is constantly located rearward of an eccentric axis in a rotational direction.

BACKGROUND ART

An internal gear pump formed by accommodating a pump rotor, which is constituted of a combination of an inner rotor and an outer rotor that are eccentrically disposed, within a rotor chamber of a housing is used as, for example, an oil pump for lubricating a vehicle engine or for an automatic transmission (AT).

The internal gear pump has an intake port and a discharge port in an end surface of the rotor chamber of the housing. A section between a terminal end of the intake port and a start end of the discharge port serves as a containment section that separates a chamber (i.e., a pump chamber) formed between the teeth of the inner rotor and the outer rotor from the intake port and the discharge port. While the aforementioned chamber moves and increases in area (volume) toward the intake port, liquid is taken into the chamber. Moreover, while the chamber moves and decreases in area toward the discharge port, the liquid within the chamber is delivered to the discharge port.

With regard to this internal gear pump, the tooth profile of the inner rotor is formed based on the following method disclosed in Patent Literature 1. With regard to the tooth profile designed based on this method (which will be described in detail later), the tooth height can be freely increased. Therefore, by increasing the volume of the chamber, the discharge rate of the pump can be increased.

By combining the inner rotor whose tooth profile is formed based on the method disclosed in Patent Literature 1 with an outer rotor whose tooth profile is formed based on the following method disclosed in Patent Literature 2, a pump rotor with relatively smooth rotation can be realized. Therefore, the tooth profile of the outer rotor to be combined is formed based on the method disclosed in Patent Literature 2.

The method disclosed in Patent Literature 2 involves revolving the center of the inner rotor along a circle having a diameter of (2e+t) (where e denotes an amount of eccentricity between the inner rotor and the outer rotor and t denotes a tip clearance between the inner rotor and the outer rotor), and rotating the inner rotor (1/n) times per revolution. An obtained envelope of a group of tooth-surface curves of the inner rotor serves as the tooth profile of the outer rotor.

CITATION LIST

Patent Literature

PTL 1: Japanese Patent No. 4600844

PTL 2: Japanese Examined Utility Model Registration Application Publication No. 6-39109

SUMMARY OF INVENTION

Technical Problem

In the pump rotor formed by combining the inner rotor whose tooth profile is formed based on the method disclosed in Patent Literature 1 and the outer rotor whose tooth profile is formed based on the method disclosed in Patent Literature 2, there is a case where the meshing point between the inner rotor and the outer rotor is constantly located rearward, in the rotational direction of the rotor, of an eccentric axis along which the center of the inner rotor and the center of the outer rotor are disposed.

In the pump rotor in which the meshing point is located rearward in the rotational direction of the rotor, the fluctuation ranges of the meshing pitch diameter and the meshing pressure angle of the inner rotor and the outer rotor tend to increase as the rotors rotate. Such large fluctuations may lead to unstable torque transmission between the inner rotor and the outer rotor, an increase in the load on a driving source, or an adverse effect on the abrasion conditions of the tooth surfaces of the rotors.

An object of the present invention is to enhance the performance of the pump by suppressing fluctuations in the meshing pitch diameter and the meshing pressure angle caused by rotation of the rotors.

Solution to Problem

In order to achieve the aforementioned object, the present invention provides an internal gear pump that includes a pump rotor in which a meshing point between an inner rotor having n teeth and an outer rotor having (n+1) teeth is located rearward, in a rotational direction of the rotor, relative to an eccentric axis along which a center of the inner rotor and a center of the outer rotor are disposed. A tooth-surface curve of the outer rotor near a meshing section thereof is formed by duplicating thereto a tooth-surface shape of the inner rotor near a meshing section thereof.

A specific example of this pump uses, for example, the following inner rotor and outer rotor. The tooth profile of the inner rotor is formed based on the following first method. The tooth profile of the outer rotor is formed based on the following second method. The tooth-surface shape of the inner rotor near the meshing section thereof (i.e., a position corresponding to a duplication area) is duplicated onto the tooth-surface curve of the outer rotor at least at an outer diameter side of a point where the positive and negative directions of a bending section located near a pitch circle of the outer rotor change.

In this case, duplication of the tooth profile of the inner rotor involves, for example, in the figure, fixing the outer rotor in position, rotating the inner rotor in this state by a small angle from the meshing position (or rotating the outer rotor in the reverse direction while fixing the inner rotor in position), and removing an area where the teeth of the inner rotor enter the outer rotor side (i.e., an area that overlaps the original tooth surface of the outer rotor). Thus, a portion of the tooth surface of the outer rotor is replaced with the tooth-surface shape of the inner rotor. This is the meaning of the term "duplication".

When performing this duplication, the relative rotation amount of the inner rotor and the outer rotor may be, for example, about 0.5° to 1°. This rotation amount may be set as follows. Specifically, at an inner rotational angle (i.e., a rotational angle of the inner rotor) at which the rotors mesh with each other at the closest position to the eccentric axis, the rotation amount may be set to an angle at which the tooth-surface shape of the inner rotor is duplicated onto the tooth-surface curve of the outer rotor at least at the outer-diameter side of the point where the positive and negative directions of the bending section located near the pitch circle of the outer rotor change.

The meshing of the teeth of the inner rotor and the outer rotor occurs only at one side of each tooth. However, with regard to each of the two rotors, it is often difficult to distinguish one surface thereof from the other surface thereof. Therefore, in order to prevent assembly mistakes, the tooth surface is corrected symmetrically so that there is no directivity in the assembly process.

In the internal gear pump according to the present invention, in addition to correcting the tooth-surface curve of the outer rotor near the meshing section thereof as described above, it is preferable that the inner rotor used for forming the tooth profile of the outer rotor be set as a tentative rotor, and a rotor obtained by narrowing the dedendum side of the teeth of the tentative rotor be set as a principal inner rotor. The principal inner rotor is preferably combined with the outer rotor whose tooth-surface curve has been corrected.

When correcting the tooth-surface curve of the outer rotor, the tooth surface at the dedendum side of the inner rotor rotated by a small angle from the meshing position is sometimes duplicated onto the tooth surface at the addendum side of the outer rotor. In that case, the meshing point may possibly shift toward the dedendum side of the inner rotor depending on the quality of the rotors. By narrowing the dedendum side of the principal inner rotor, meshing at the dedendum side of the inner rotor is prevented, thereby avoiding shifting of the meshing point. Accordingly, fluctuations in the meshing pitch diameter and the meshing pressure angle can be suppressed.

Advantageous Effects of Invention

With the internal gear pump according to the present invention, since the tooth-surface curve of the outer rotor at the meshing section thereof is given a shape obtained by duplicating thereto the tooth-surface shape of the inner rotor at the meshing section thereof, extreme shifting of the meshing point is prevented even when the rotors rotate.

Therefore, fluctuations in the meshing pitch diameter and the meshing pressure angle can be minimized so that torque transmission between the inner rotor and the outer rotor can be made stable, thereby reducing the load on a driving source as well as suppressing abnormal abrasion of the tooth surfaces of the rotors.

BRIEF DESCRIPTION OF DRAWINGS

FIG. 2(*b*) is an image diagram illustrating how the center of the forming circle having the fixed diameter moves.

FIG. 7(*b*) illustrates how the meshing pitch-circle diameter and the meshing pressure angle fluctuate in the pump rotor according to Invention 1.

FIG. 7(*c*) illustrates how the meshing pitch-circle diameter and the meshing pressure angle fluctuate in the pump rotor according to Invention 1.

FIG. 7(*d*) illustrates how the meshing pitch-circle diameter and the meshing pressure angle fluctuate in the pump rotor according to Invention 1.

FIG. 7(*e*) illustrates how the meshing pitch-circle diameter and the meshing pressure angle fluctuate in the pump rotor according to Invention 1.

DESCRIPTION OF EMBODIMENT

An internal gear pump according to an embodiment of the present invention will be described below with reference to the appended drawings of FIGS. 1 to 6.

Figure 1:
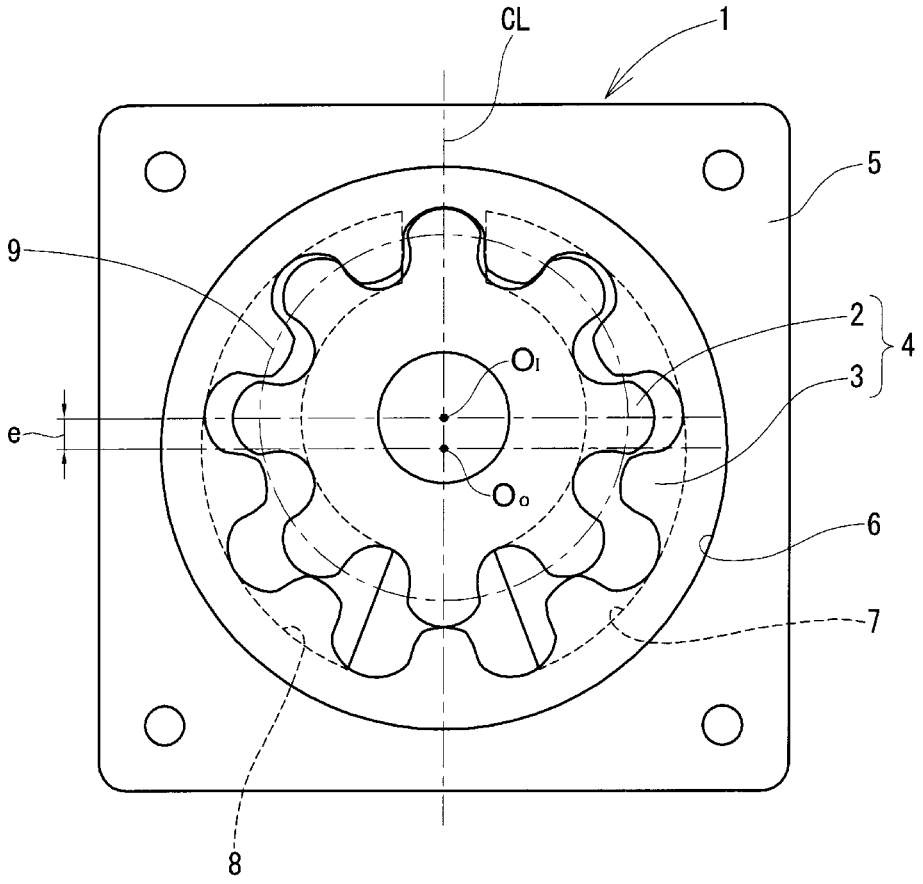
FIG. 1 is an end-surface diagram illustrating an example of an internal gear pump according to the present invention, showing a state where a cover is removed from a housing.

In an internal gear pump 1 shown in FIG. 1, a pump rotor 4 is formed by combining an inner rotor 2 having n teeth and an outer rotor 3 having (n+1) teeth and eccentrically disposing the rotors relative to each other. The pump rotor 4 is accommodated within a rotor chamber 6 in a housing 5, whereby the internal gear pump 1 is formed. Reference character $O_I$ denotes the center of the inner rotor, reference character $O_O$ denotes the center of the outer rotor, and reference character e denotes an amount of eccentricity between the inner rotor 2 and the outer rotor 3. An intake port 7 and a discharge port 8 are formed in an end surface of the rotor chamber 6.

A tooth profile of the inner rotor 2 is formed based on the following first method by using a base circle A that is concentric with the inner rotor, an addendum forming circle B, and a dedendum forming circle C. The forming circles B and C each have, on the circumference thereof, a point j that passes through an intersecting point (reference point J) between the base circle A and a Y axis.

The first method for forming the tooth profile of the inner rotor 2 is as follows. As shown FIGS. 2(*a*) and 2(*b*), the addendum forming circle B and the dedendum forming circle C are first moved on the basis of the following conditions (1) to (3). During that time, a locus curve is drawn by the point j on each of the forming circles B and C aligned with the reference point J on the base circle A concentric with the center $O_I$ of the inner rotor. Subsequently, the locus curve is inverted symmetrically with respect to a line $L_2$, $L_3$ extending from the center $O_I$ of the base circle to an addendum point $T_T$ or a dedendum point $T_B$, whereby at least one of an addendum tooth-surface curve and a dedendum tooth-surface curve of the inner rotor is formed.

Movement Conditions (1) to (3) of Forming Circles B and C (1) Each forming circle B, C is disposed such that the point j on the forming circle is in alignment with the reference point J on the base circle A. A center pa, pb of the forming circle at that time is set as a movement start point Spa, Spb. While rotating the forming circle B, C from the movement start point Spa, Spb at a constant rate, the center pa, pb of the forming circle is moved along a forming circle-center movement curve $AC_1$, $AC_2$ until the center of the forming circle reaches a movement end point Lpa, Lpb. The movement end point Lpa, Lpb corresponds to a position where the point j on the forming circle B, C reaches the addendum point $T_T$ or the dedendum point $T_B$. A locus curve drawn by the point j on the forming circle B, C based on this condition (1) serves as the tooth profile of the inner rotor.

(2) With regard to the distance, in the radial direction, from the center $O_I$ of the inner rotor to the center pa, pb of the forming circle, the distance increases for an addendum tooth-surface curve 2*a* and decreases for a dedendum tooth-surface curve 2*b* from the movement start point Spa, Spb to the movement end point Lpa, Lpb.

Figure 2A:
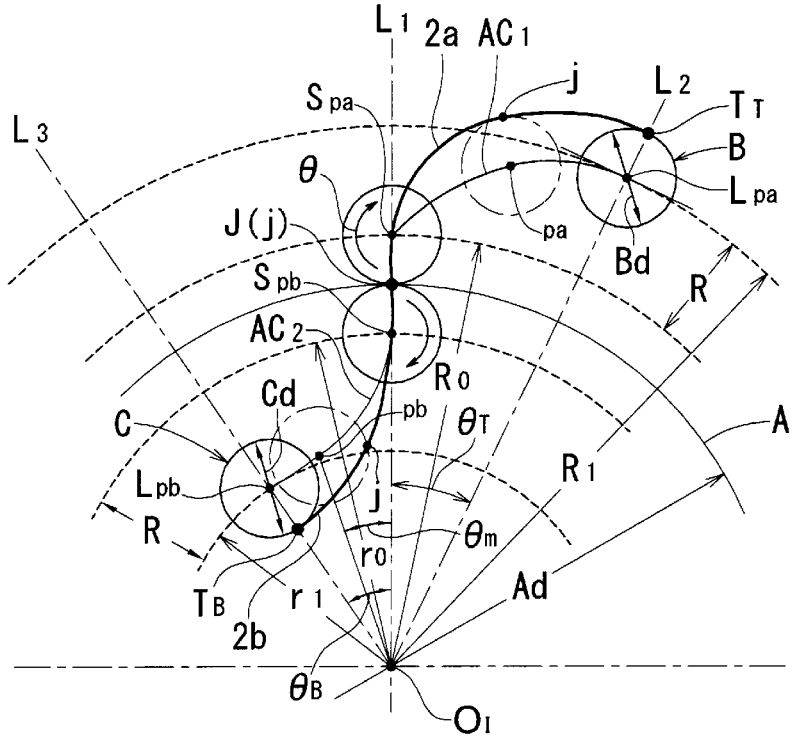
FIG. 2(*a*) illustrates a method for forming a tooth profile of an inner rotor in FIG. 1 by using a forming circle having a fixed diameter.
Figure 2B:
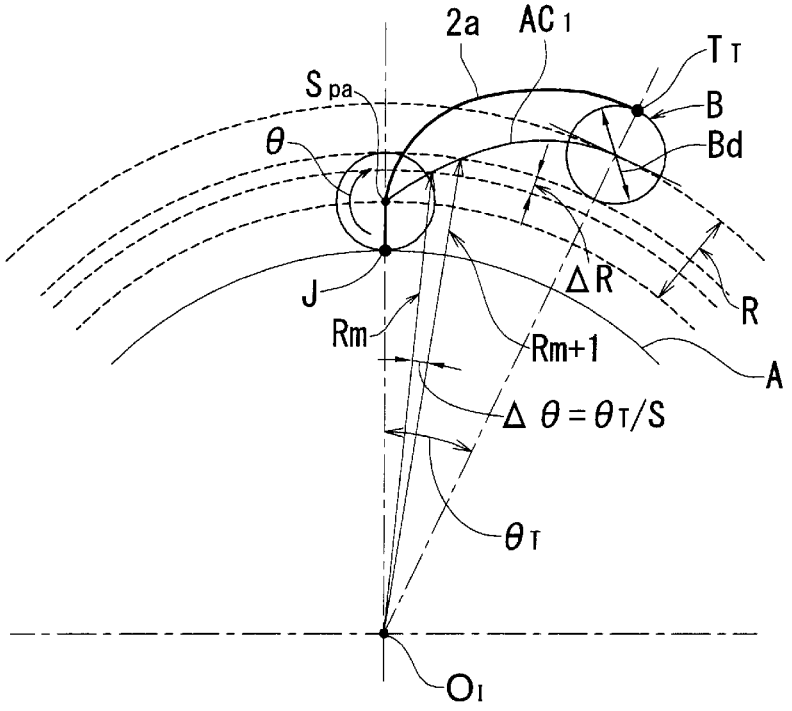

Accordingly, in FIG. 2(*a*), the movement curves $AC_1$ and $AC_2$ are a curve that slopes up to the right at the addendum side and a curve that slopes down to the left at the dedendum side, respectively. Thus, an addendum and a dedendum with smooth curves drawn by the aforementioned point j are formed.

(3) In the radial direction of the base circle A, the distance between the center ($O_I$) of the base circle and the addendum point ($T_T$) is larger than a sum of a distance ($R_o$) between the movement start point (Spa) of the forming circle (B) and the center ($O_I$) of the base circle and the radius of the forming circle (B) at the movement start point, or the distance between the center ($O_I$) of the base circle and the dedendum point ($T_B$) is smaller than a difference obtained by subtracting the radius of the forming circle (C) at the movement start point from a distance ($r_o$) between the movement start point (Spb) of the forming circle (C) and the center ($O_I$) of the base circle.

Based on these conditions, a tooth drawn by the locus curve of the point j has a larger height than that of a tooth profile of a cycloid curve drawn by a rolling circle that rolls along the base circle.

Each forming circle B, C is selected from one of a circle that moves from the movement start point to the movement end point while a diameter Bd, Cd thereof is maintained and a circle that moves from the movement start point to the movement end point while the diameter Bd, Cd thereof decreases. With regard to the latter forming circle whose diameter changes during the movement thereof, the diameter at the movement end point is preferably 0.2 times to 1 times the diameter at the movement start point.

Although the movement start point Spa, Spb of the center pa, pb of each forming circle is placed on a line $L_1$ in FIG. 2(*a*), the movement start point Spa, Spb may sometimes be placed in front of the line $L_1$ in the moving direction of the forming circle.

Furthermore, the movement end point Lpa, Lpb of the center pa, pb of each forming circle is sometimes set at a position displaced from the line $L_2$, $L_3$.

With regard to each of the movement curves $AC_1$ and $AC_2$, for example, a curve in which a rate of change ΔR' in the distance from the center $O_I$ of the inner rotor to the center pa, pb of the forming circle is zero at the movement end point Lpa, Lpb or the following curve that utilizes a sine function is used.

For example, in the curve, a movement distance ΔR, in the radial direction of the base circle, of the center pa, pb of the forming circle moving from the movement start point Spa, Spb to the movement end point Lpa, Lpb satisfies the following expression.

$$\Delta R = R \times \sin\{(\pi/2) \times (m/S)\}$$

where

R: a movement distance of the forming circle in the radial direction (i.e., (a distance from the center $O_I$ of the inner rotor to the center pa of the forming circle located at the movement end point)—(a distance from the center $O_I$ of the inner rotor to the center pa of the forming circle located at the movement start point)), S: the number of steps (i.e., the number of segments into which a movement angle $\theta_T$ or $\theta_B$ between the movement start point and the movement end point of the forming circle is equally segmented), and m: 0→S.

The movement angles $\theta_T$ and $\theta_B$ of the forming circles B and C are set in view of, for example, the number of teeth and the ratio of areas where the addendums and the dedendums are to be set.

Figure 3:
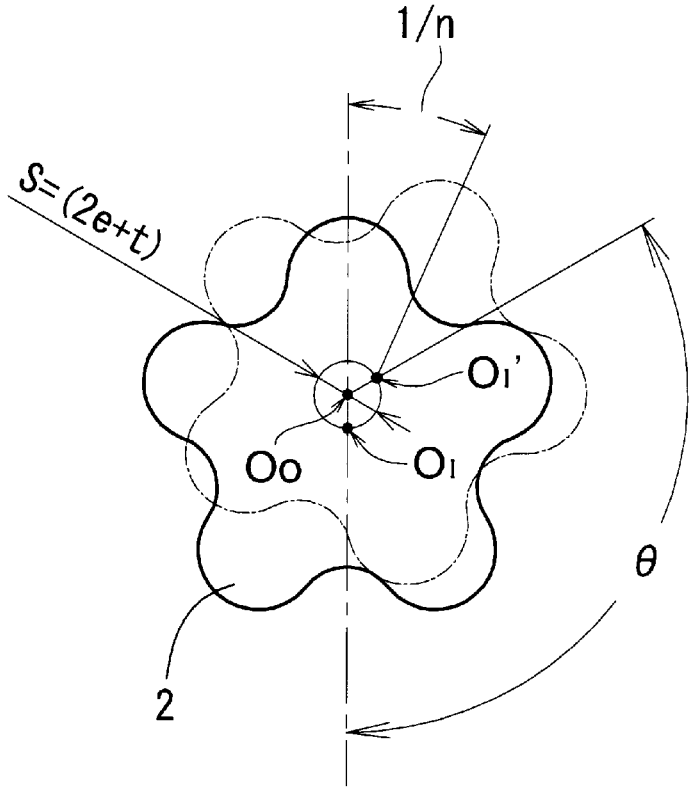
FIG. 3 illustrates a method for forming a tooth-surface curve of an outer rotor.

Next, the tooth profile of the outer rotor 3 is formed based on the second method by using the inner rotor 2 formed based on the aforementioned first method. As shown in FIG. 3, the second method involves revolving the center $O_I$ of the inner rotor 2 by one lap along a circle having a diameter of (2e+t) centered on the center $O_O$ of the outer rotor 3 (e denoting an amount of eccentricity between the inner rotor and the outer rotor and t denoting a tip clearance between the inner rotor and the outer rotor) and rotating the inner rotor 2 (1/n) times during the revolution. An envelope of a group of tooth-surface curves of the inner rotor at that time serves as an original tooth profile of the outer rotor 3.

Then, the original tooth profile undergoes the following correction. Specifically, the tooth-surface shape of a corresponding position of the inner rotor is duplicated onto the tooth-surface curve of the original tooth profile at least at the outer diameter side of a point where the positive and negative directions of a bending section located near a pitch circle change.

In FIG. 1, when the outer rotor 3 is fixed in position and the inner rotor 2 is moved into contact with the outer rotor in an upward direction of an eccentric axis CL (i.e., upward direction in the drawing), the tip clearance t between the inner rotor and the outer rotor corresponds to gaps formed between the teeth of the inner rotor and the outer rotor along the eccentric axis CL at opposite sides of the contact point (i.e., opposite sides across the rotor center).

Figure 4:
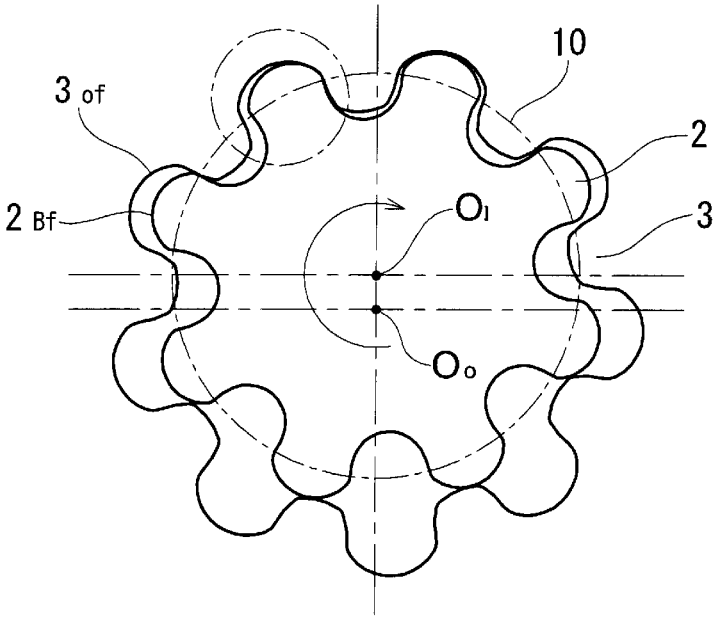
FIG. 4 illustrates a method for correcting the tooth-surface curve of the outer rotor.
Figure 5:
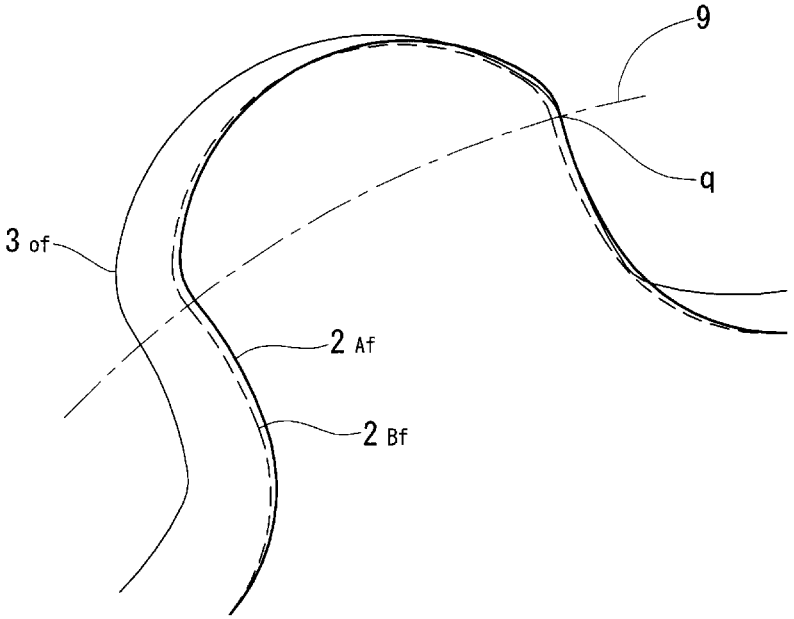
FIG. 5 is an enlarged view of a circled section in FIG. 4.

FIGS. 4 and 5 illustrate a specific example of the aforementioned correction method. The inner rotor 2 and the outer rotor 3 are eccentrically disposed relative to each other by e on the eccentric axis, and the teeth of the two rotors are meshed with each other. In this state, for example, the outer rotor 3 is fixed, whereas the inner rotor is rotated by a small angle. The rotational angle in this case may be, for example, about 0.5° to 1°. Due to this rotation, the addendum of the inner rotor 2 becomes disposed within the tooth surface of the outer rotor, as shown in FIG. 5.

In FIGS. 4 and 5, reference numeral $\mathbf{3}_{Of}$ denotes the original tooth profile of the outer rotor, reference numeral $\mathbf{2}_{Bf}$ denotes the tooth surface of the inner rotor before the rotation, reference numeral $\mathbf{2}_{Af}$ denotes the tooth surface of the inner rotor after the rotation, and reference numeral 9 denotes the pitch circle of the outer rotor.

The rotation of the inner rotor 2 causes a portion of the tooth surface of the inner rotor to enter the original tooth profile $\mathbf{3}_{Of}$ of the outer rotor. This entry occurs at least at the outer diameter side of the rotor relative to a point q where the positive and negative directions of the bending section of the tooth-surface curve located near the pitch circle 9 change. The tooth-surface shape of the inner rotor is duplicated onto the tooth surface of the outer rotor by removing the position where the tooth surface of the inner rotor is aligned with the original tooth profile of the outer rotor.

Consequently, the meshing point between the inner rotor 2 and the outer rotor is prevented from moving extremely toward the addendum side for the inner rotor or toward the dedendum side for the outer rotor, thereby suppressing fluctuations in the meshing pitch diameter and the meshing pressure angle.

At a position where the inner rotor 2 is rotated by a required amount, the tooth surface $\mathbf{2}_{Af}$ of the inner rotor after the rotation may sometimes slightly enter the addendum tooth surface of the original tooth profile $\mathbf{3}_{Of}$ of the outer rotor at the inner diameter side of the pitch circle 9, depending on the tooth profile, as shown in FIG. 5. In that case, the tooth surface of the outer rotor at a position where the tooth surface of the original tooth profile $\mathbf{3}_{Of}$ of the outer rotor is aligned with the inner rotor may be corrected and removed.

Figure 6:
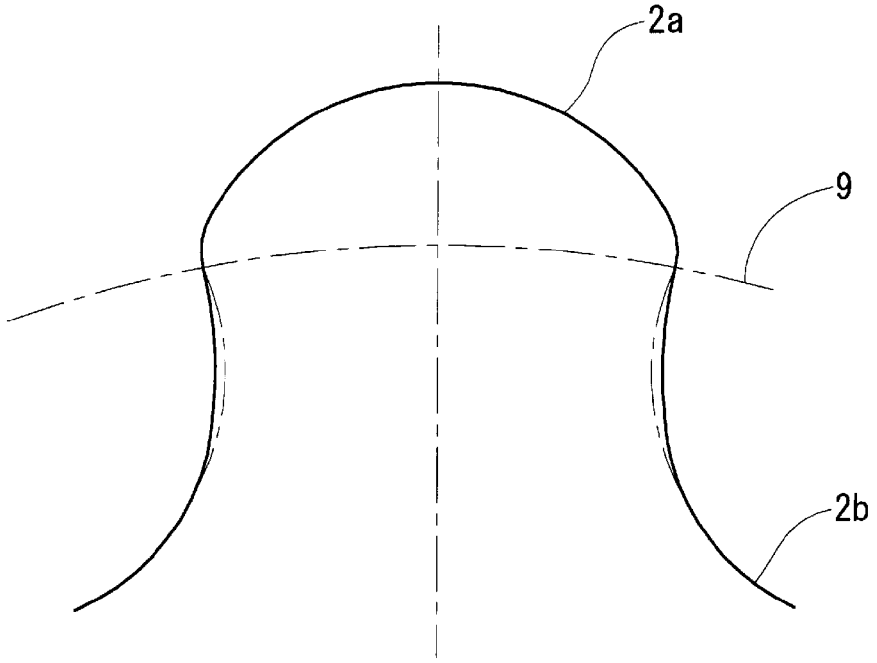
FIG. 6 illustrates a difference in an addendum side between a tentative inner rotor and a principal inner rotor.
Figure 7A:
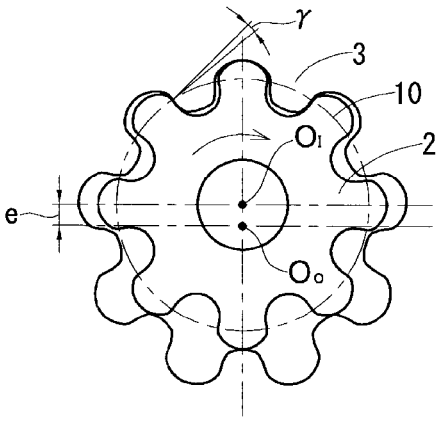
FIG. 7(*a*) illustrates how a meshing pitch-circle diameter and a meshing pressure angle fluctuate in a pump rotor according to Invention 1.
Figure 7B:
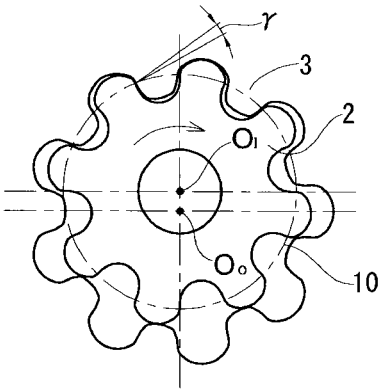
Figure 7C:
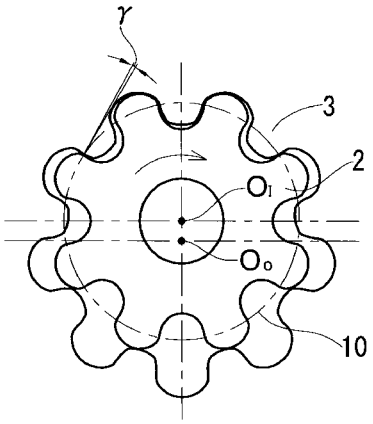
Figure 7D:
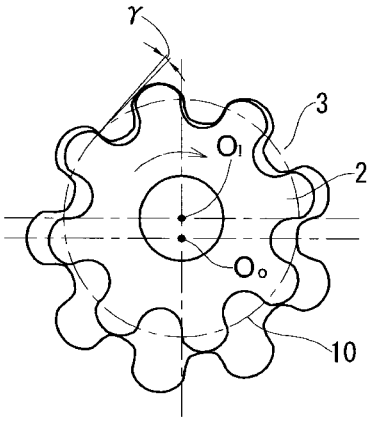
Figure 7E:
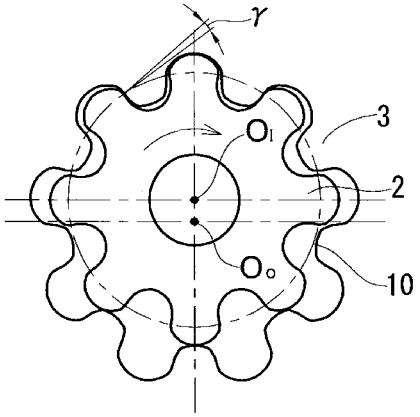

With regard to the inner rotor, an inner rotor used for forming the tooth profile of the outer rotor (i.e., the inner rotor whose tooth profile is formed based on the aforementioned first method) is preferably used as a tentative inner rotor, and a principal inner rotor obtained by narrowing the dedendum side of the teeth of the tentative inner rotor, as denoted by a dotted chain line in FIG. 6 (a solid line in this drawing denotes the tooth profile of the tentative inner rotor), is preferably combined with the outer rotor 3.

An example of a method for narrowing the dedendum side of the teeth of the tentative inner rotor includes changing the movement range, in the radial direction, of the forming circle C, which is used for forming the dedendum side in the aforementioned first method, relative to the base circle A. Specifically, an angle $\theta_m$ in which the distance between the center of the base circle A and the center of the forming circle C changes is made smaller in the principal inner rotor than in the tentative inner rotor.

An alternative method for narrowing the dedendum side of the principal inner rotor includes drawing the tooth profile of the tentative inner rotor based on the aforementioned first method by using the forming circle C whose diameter decreases during the movement thereof, and forming the tooth profile of the principal inner rotor by drawing the dedendum tooth-surface curve such that the diameter-decreasing rate of the forming circle C when forming the tooth profile of the principal inner rotor based on the aforementioned first method is smaller than that when forming the tooth profile of the tentative inner rotor.

By narrowing the dedendum side of the principal inner rotor relative to that of the tentative inner rotor, the meshing point between the tooth surface of the outer rotor and the principal inner rotor can be prevented from being displaced toward the addendum side of the principal inner rotor, thereby further reducing fluctuations in the meshing pitch diameter and the meshing pressure angle as compared with a case where the tooth surface of the outer rotor alone is corrected.

EXAMPLES

An inner rotor is fabricated based on the aforementioned first method under the following conditions.

Diameter of Base Circle A: 32.9 mm

Half-Tooth Angle from Dedendum to Addendum (i.e., Movement Angle ($\theta_T$, $\theta_B$) from Movement Start Point to Movement End Point of Forming Circle): 22.5°

Diameter Bd of Forming Circle B: 2.056 mm

Diameter Cd of Forming Circle C: 2.056 mm

Movement Distance of Forming Circle B in Radial Direction: 0.029 mm

Movement Distance of Forming Circle C in Radial Direction: 1.727 mm

Number S of Movement Steps of Each Forming Circle B, C: 60

Large Diameter: 37.04 mm

Small Diameter: 25.4 mm

Number of Teeth: 8

An outer rotor is fabricated based on the aforementioned second method by using the inner rotor.

Amount e of Eccentricity: 2.76 mm

Tip Clearance t: 0.08 mm

Large Diameter: 42.64 mm

Small Diameter: 31.6 mm

Number of Teeth: 9

Subsequently, the inner rotor and the outer rotor are combined, and the dedendum tooth-surface curve of the outer rotor is corrected in the following manner. Specifically, at an inner rotational angle at which the inner rotor and the outer rotor mesh with each other at the closest position to the eccentric axis, the inner rotor is rotated forward in the rotational direction by 0.635° from the meshing position in a state where the outer rotor is fixed in position, so that the tooth surface of the inner rotor after the rotation is duplicated. Then, the corrected outer rotor and the inner rotor are combined, whereby a prototype of a pump rotor is made (Invention 1).

Furthermore, the inner rotor used for forming the tooth profile of the outer rotor is set as a tentative inner rotor, and a principal inner rotor obtained by narrowing the dedendum side of the tentative inner rotor, as denoted by a chain line in FIG. 6, is combined with the corrected outer rotor, whereby a prototype of a pump rotor is made (Invention 2).

Subsequently, fluctuations in the meshing pitch diameter and the meshing pressure angle are studied for the pump rotors according to Inventions 1 and 2 and a pump rotor according to a comparative example in which the tooth profile of the outer rotor is not corrected (but having specifications similar to those of Invention 1 except for the tooth profile of the outer rotor).

With regard to the pump rotor according to Invention 1, a state where the inner rotor is located at a reference position is illustrated in FIG. 7(*a*), a state where the inner rotor is rotated by 10° from the reference position is illustrated in FIG. 7(*b*), a state where the inner rotor is rotated by 20° is illustrated in FIG. 7(*c*), a state where the inner rotor is rotated by 30° is illustrated in FIG. 7(*d*), and a state where the inner rotor is rotated by 40° is illustrated in FIG. 7(*e*). Reference numeral 10 denotes a meshing pitch circle, and reference character γ denotes a meshing pressure angle. The rotational direction of the rotor is the clockwise direction, as indicated by an arrow in each drawing. At each inner-rotor rotational angle, the outer rotor is rotated counterclockwise so that the inner rotor and the outer rotor are meshed with each other.

Table I and Table II show measurement data of a meshing pitch-circle diameter and a meshing pressure angle obtained when the pump rotors according to Invention 1, Invention 2, and the comparative example are each rotated by 5°, 10°, 15°, 20°, 25°, 30°, 35°, and 40° from a theoretical eccentric position.

TABLE I

Meshing pitch-circle diameter (unit: mm).

| Rotor rotational angle | 0° | 5° | 10° | 15° |
|---|---|---|---|---|
| Invention 1 | 31.592 | 31.098 | 30.877 | 31.064 |
| Invention 2 | 32.696 | 32.730 | 32.759 | 32.903 |

TABLE I-continued

| Meshing pitch-circle diameter (unit: mm). | | | | |
|---|---|---|---|---|
| Comparative example | | 32.978 | 33.145 | 33.327 | 33.691 |
| 20° | 25° | 30° | 35° | 40° |
| 32.906 | 32.908 | 32.896 | 32.462 | 31.863 |
| 32.903 | 32.900 | 32.879 | 32.905 | 32.720 |
| 34.203 | 34.702 | 32.916 | 32.904 | 32.931 |

TABLE II

| Meshing pressure angle γ (unit: °). | | | | |
|---|---|---|---|---|
| Rotor rotational angle | | 0° | 5° | 10° | 15° |
| Invention 1 | | 4.15 | 6.11 | 6.94 | 6.26 |
| Invention 2 | | 0.53 | 0.49 | 0.42 | 0.22 |
| Comparative example | | 8.18 | 14.80 | 19.91 | 27.55 |
| 20° | 25° | 30° | 35° | 40° |
| 0.89 | 1.05 | 0.93 | 1.63 | 3.31 |
| 0.29 | 0.51 | 0.31 | 0.53 | 0.51 |
| 36.12 | 43.42 | 3.36 | 0.85 | 5.23 |

Figure 8:
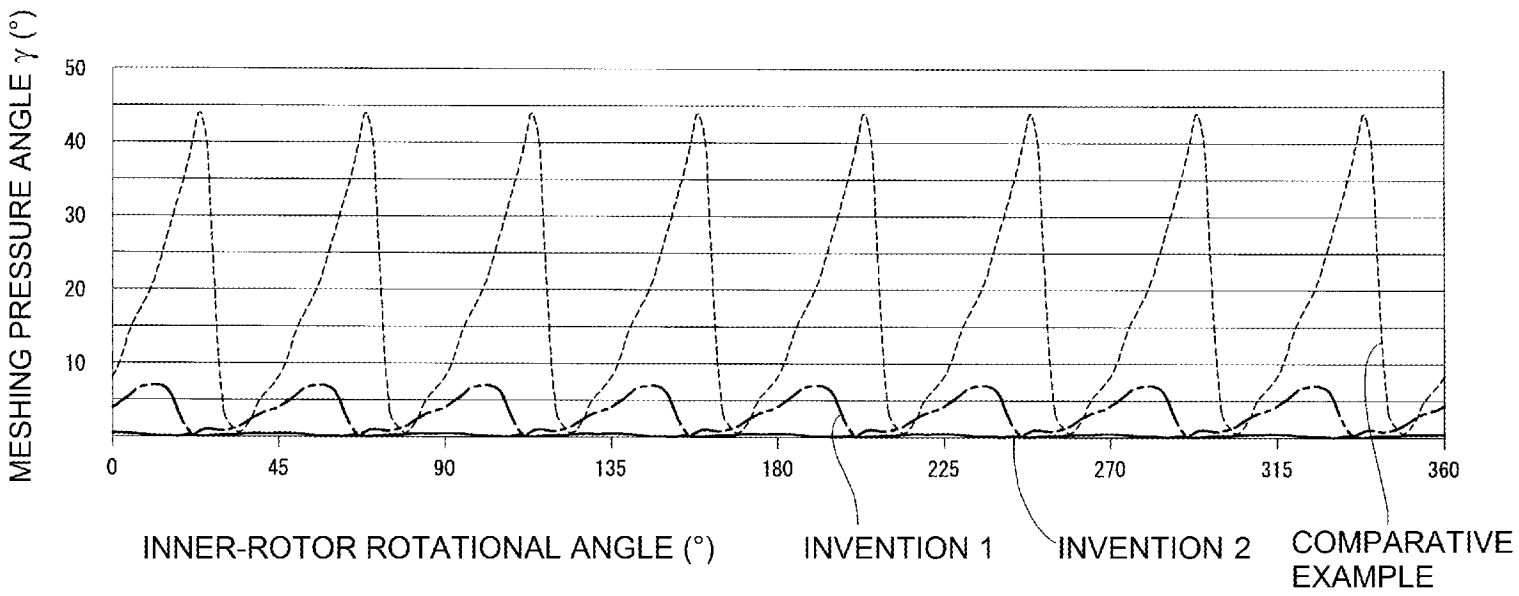
FIG. 8 is a graph of data that compares fluctuations in the meshing pressure angle.

FIG. 8 is a graph of the data in Table II.

As it is apparent from this evaluation result, the meshing pitch diameter in the comparative example fluctuates relatively significantly between 32.904 mm and 34.702 mm inclusive. Moreover, the meshing pressure angle γ also fluctuates significantly between 0.85° and 43.42° inclusive.

In contrast, although the meshing pitch diameter in Invention 1 fluctuates between 30.877 mm and 32.908 mm inclusive, the meshing pressure angle γ fluctuates between 0.87° and 6.94° inclusive, which is smaller than the comparative example.

In Invention 2, the meshing pitch diameter ranges between 32.696 mm and 32.903 mm inclusive and the meshing pressure angle γ ranges between 0.29° and 0.53° inclusive. Thus, the fluctuation ranges of both the meshing pitch diameter and the meshing pressure angle are smaller than those in the comparative example.

REFERENCE SIGNS LIST

1 internal gear pump
2 inner rotor
2*a* addendum tooth-surface curve
2*b* dedendum tooth-surface curve
$\mathbf{2}_{Bf}$ tooth surface of inner rotor before rotation
$\mathbf{2}_{Af}$ tooth surface of inner rotor after rotation
3 outer rotor
$\mathbf{3}_{Of}$ original tooth profile of outer rotor
4 pump rotor
5 housing
6 rotor chamber
7 intake port
8 discharge port
9 pitch circle of outer rotor
10 meshing pitch circle
$O_I$ center of inner rotor (center of base circle)
$O_O$ center of outer rotor
A base circle
Ad diameter of base circle
B addendum forming circle
C dedendum forming circle
Bd, Cd diameter of forming circle
$AC_1$, $AC_2$ movement curve along which center of forming circle travels
R movement distance of forming circle in radial direction
$R_O$ distance between movement start point Spa of forming circle B and center $O_I$ of base circle
$r_O$ distance between movement start point Spb of forming circle C and center $O_I$ of base circle
$\theta_T$, $\theta_B$ movement angle of forming circle
J reference point on base circle
j point by which locus curve is drawn
$T_T$ addendum point
$T_B$ dedendum point
$L_1$ line connecting center of inner rotor and reference point J
$L_2$ line connecting center of inner rotor and addendum
$L_3$ line connecting center of inner rotor and dedendum
pa, pb center of forming circle
Spa, Spb movement start point of forming circle
Lpa, Lpb movement end point of forming circle
S number of steps
e amount of eccentricity between center of inner rotor and center of outer rotor
t tip clearance
q point where positive and negative directions of bending section of dedendum tooth-surface curve of outer rotor change
CL eccentric axis

The invention claimed is:

1. An internal gear pump comprising a pump rotor (4) in which a meshing point between an inner rotor (2) having n teeth and an outer rotor (3) having (n+1) teeth is located rearward, in a rotational direction of the inner rotor, relative to an eccentric axis (CL) along which a center ($O_I$) of the inner rotor and a center ($O_O$) of the outer rotor are disposed, wherein an outer rotor tooth profile at an outer side of the outer rotor relative to a changing point where positive and negative directions of the tooth-surface curve connect, is a duplicate of an inner rotor tooth profile, wherein the inner rotor tooth profile is formed by a first method, and the outer rotor tooth profile is formed by a second method, and wherein the tooth-surface shape of a corresponding position of the inner rotor (2) is duplicated onto the tooth-surface curve of the outer rotor (3) at least at an outer side of a point (q) where the positive and negative directions of the tooth-surface curve, located near a pitch circle of the outer rotor (3), change, wherein the first method includes:

moving an addendum forming circle (B) and a dedendum forming circle (C) on a basis of first to third movement conditions, drawing a locus curve of a point (j) on each forming circle (B, C) that is aligned with a reference point (J) on a base circle (A) concentric with the center ($O_I$) of the inner rotor during the movement, and inverting the locus curve symmetrically with respect to a line ($L_2$, $L_3$) extending from the center ($O_I$) of the base circle to an addendum point ($T_T$) or a dedendum point ($T_B$) so as to obtain a tooth-surface curve of the inner rotor, wherein the movement conditions of each forming circle (B, C) include:

the first movement condition in which each forming circle (B, C) is disposed such that the point (j) on the forming circle is in alignment with the reference point (J) on the base circle (A), a center (pa, pb) of the forming circle at that time is set as a movement start point (Spa, Spb), and the forming circle (B, C) is rotated from the movement start point (Spa, Spb) at a constant rate while the center of the forming circle is moved along a forming circle-center movement curve ($AC_1$, $AC_2$) until the center (pa, pb) of the forming circle reaches a movement end point (Lpa, Lpb), the second movement condition in which a distance, in a radial direction, from the center ($O_I$) of the inner rotor to the movement curve ($AC_1$, $AC_2$) increases for an addendum tooth-surface curve (2*a*) and decreases for a dedendum tooth-surface curve (2*b*) from the movement start point (Spa, Spb) to the movement end point (Lpa, Lpb), and the third movement condition in which, in the radial direction of the base circle (A), a distance between the center ($O_I$) of the base circle and an addendum point ($T_T$) is larger than a sum of a distance ($R_o$) between the movement start point (Spa) of the forming circle (B) and the center ($O_I$) of the base circle and a radius of the forming circle (B) at the movement start point, or a distance between the center ($O_I$) of the base circle and the dedendum point ($T_B$) is smaller than a difference obtained by subtracting a radius of the forming circle (C) at the movement start point from a distance ($r_o$) between the movement start point (Spb) of the forming circle (C) and the center ($O_I$) of the base circle, and wherein the second method includes:

revolving the center ($O_I$) of the inner rotor by one lap along a circle having a diameter of (2e+t) centered on the center ($O_o$) of the outer rotor and rotating the inner rotor (1/n) times during the revolution so as to use an envelope of a group of tooth-surface curves of the inner rotor at that time as a tentative outer rotor tooth profile, e denoting an amount of eccentricity and t denoting a tip clearance, and forming a principal outer rotor tooth profile by duplicating the tentative outer rotor tooth profile at an outer side of the outer rotor relative to the changing point where the positive and negative directions of the tooth-surface curve change to the inner rotor tooth profile.

2. The internal gear pump according to claim 1, wherein the inner rotor used for forming a tooth profile of the outer rotor (3) is set as a tentative inner rotor and a rotor obtained by narrowing a side of teeth of the tentative inner rotor is set as a principal inner rotor, and wherein the outer rotor and the principal inner rotor are combined.

* * * * *